United States Patent [19]

Schmitt et al.

[11] Patent Number: 4,756,150

[45] Date of Patent: Jul. 12, 1988

[54] MOUNT FOR A TEXTILE SPINDLE

[75] Inventors: Günther Schmitt; Günter Oppl; Armin Bohn, all of Hammelburg, Fed. Rep. of Germany

[73] Assignee: FAG Kugelfischer Georg Schafer (KGaA), Fed. Rep. of Germany

[21] Appl. No.: 59,374

[22] Filed: Jun. 8, 1987

[30] Foreign Application Priority Data

Jun. 7, 1986 [DE] Fed. Rep. of Germany ..... 3619250

[51] Int. Cl.[4] ..... D01H 7/08; D01H 7/12

[52] U.S. Cl. ..... 57/88; 57/130; 57/132; 57/135

[58] Field of Search ..... 57/88, 89, 129–135

[56] References Cited

U.S. PATENT DOCUMENTS

| | | | |
|---|---|---|---|
| 2,611,231 | 9/1952 | Keene | 57/130 |
| 2,650,465 | 9/1953 | Westall | 57/132 X |
| 2,668,087 | 2/1954 | Sousloff et al. | 57/130 X |
| 2,696,707 | 12/1954 | Meadows | 57/130 |
| 2,954,661 | 10/1960 | Rowe, Jr. | 57/132 |
| 3,406,512 | 10/1968 | Stahlecker | 57/130 X |
| 3,555,804 | 1/1971 | Murph | 57/132 |
| 4,430,850 | 2/1984 | Igel et al. | 57/130 |
| 4,445,320 | 5/1984 | Oppl et al. | 57/88 |

*Primary Examiner*—John Petrakes

*Attorney, Agent, or Firm*—Ostrolenk, Faber, Gerb & Soffen

[57] ABSTRACT

A mount for spinning spindles which discloses various embodiments of wedge type clamping devices for clamping a sleeve, which is disposed around the spindle housing, securely to a spindle bearing plate. The sleeve surrounds the spindle housing with vibration damping elements between them. The wedge clamping devices are driven by a threaded nut which is tightened up around the sleeve and this clamps the sleeve to the plate. A device for separating the drive belt from the drive whorl of the spindle is attachable on the sleeve and presses the belt off the drive whorl, freeing the spindle so that it may then be unclamped for removal from the spindle bearing plate.

20 Claims, 6 Drawing Sheets

MOUNT FOR A TEXTILE SPINDLE

BACKGROUND OF THE INVENTION

The present invention relates to a mount for a filament spinning or twisting spindle. It is particularly useful for hollow spindles.

In filament wrapping and twisting machines, spindles are used which rotate at a high speed, sometimes up to 35,000 rpm. These spindles should be frequently relubricated. For this purpose, they must be removable from the machine. Furthermore, the spindles are susceptible to becoming dirtied, for instance, upon the processing of a man-made filament, like Lycra (trademark), in combination with talcum. The spindles must be frequently removed from the machine for cleaning.

Filament processors who spin filaments demand that the spindles be removable from the machine so that the production by those spindles which are still intact and on the machine is not interrupted. Until now, this requirement could not be satisfied. For instance, with spindles which could easily be installed using a sliding seat, fretting corrosion occurred within a relatively short time as a result of the high vibration which each spindle generated and to which all of the spindles were therefore exposed. After corrosion occurred, it was no longer possible to loosen the spindles from their receiving housing, even through the use of external means.

The spindles are supported on a common spindle bearing plate. The spindles are customarily fastened to the plate so that a spacer bushing, a threaded nut and a lock nut are all arranged below that plate. During any replacement, reconstruction or repair of a spindle, the entire spindle therefore had to be removed from the machine. To remove the spindle, the machine had to be entirely stopped.

SUMMARY OF THE INVENTION

It is the primary object of the present invention to provide a spindle mount which prevents fretting corrosion and, more important, which enables removal of the spindle from the machine while the machine is operating, and without it being first necessary to turn off the machine. All spindles are supported on a common spindle bearing plate means. Each spindle is driven to rotate by a common drive means. That common drive means may comprise a drive belt which moves past each of the spindles. Each spindle includes a drive whorl on the spindle which is frictionally engaged by the drive belt and is driven to rotate the spindle. Separation of the drive belt from the drive whorl causes the spindle to stop rotating.

The present invention shows various embodiments of means for clamping the spindle to the spindle bearing plate. The various embodiments share a number of features in common. All include a rotatable spindle which is supported in bearings to rotate inside a stationary spindle housing. All employ a sleeve, and particularly a longitudinally slit sleeve which is disposed around the spindle and the spindle housing, and which is attached to the spindle housing through vibration damping elements. The slit sleeve, with its spindle and vibration clamping elements in it, is installed via a sliding seat into the spindle bearing plate, e.g. by installation into a clamping ring at the receiving opening in that plate. Also, in all embodiments, the slit sleeve is affixed to the spindle bearing plate through wedge or frustoconical means which, on the one hand, are connected to the spindle bearing plate and, on the other hand, are connected with the sleeve. The wedge means are clamped by appropriate clamping means, e.g. a clamping nut movable along the outside of the slit sleeve, which provides an axial force along the sleeve which tightens the wedge means to hold the slit sleeve to the bearing plate. Details of particular wedge means effecting the connection between the slit sleeve and the bearing plate are described below in detail in connection with each embodiment.

Further, each embodiment of the slit sleeve includes means which support a device for lifting the drive belt for the spindles off the drive whorl on the spindle, for disconnecting that particular spindle from the drive belt prior to its removal from the spindle bearing plate, without interfering with the operation of the other spindles.

The means for lifting the drive belt off a spindle drive whorl is located preferably at the head or top end of the slit sleeve and particularly may comprise holding or guide grooves for the lifting device. The lifting device includes one or more rollers which contact the drive belt and are moved to push the drive belt off the drive whorl of the respective spindle.

As noted above, in all of the embodiments, two vibration damping elements are arranged with a press fit on the stationary spindle housing. This complete unit is then guided with a sliding seat into a sleeve which has been longitudinally slit over its entire length. The sleeve has a resting flange which in various embodiments either comes to rest directly on the spindle bearing plate or on the corresponding bushing which, in turn, communicates with the spindle bearing plate. Through various known frustoconical clamping elements which are also slit, both radial and axial clamping is obtained. The vibration damping elements achieve a firm seat which withstands all vibration and prevents the production of fretting corrosion. No matter which embodiment is considered, whether the clamping ring extends into a conical recess in the spindle bearing plate or into a conically milled space in a bushing provided particularly for this purpose, the conical connection effects the locking of the slit sleeve to the spindle bearing plate.

A single threaded nut clamps and fastens the spindle by axially clamping the slit sleeve or the bushing connected with the slit sleeve to the spindle bearing plate. Corresponding loosening of the threaded nut unclamps the conical connections which frees the spindle to be removed without difficulty from its supported position in the spindle bearing plate. This is easily accomplished while the drive belt continues to operate, for example, for operating all of the other spindles. The drive belt is lifted off the drive whorl of the selected spindle to be removed by a device having a roller or preferably two rollers which press against the belt to lift it off the drive whorl. Other such belt and drive whorl separating means may instead be provided.

Other objects and features of the present invention will be explained below with reference to the accompanying drawings showing the various embodiments of the invention.

DESCRIPTION OF THE PREFERRED EMBODIMENTS

Figure 1:
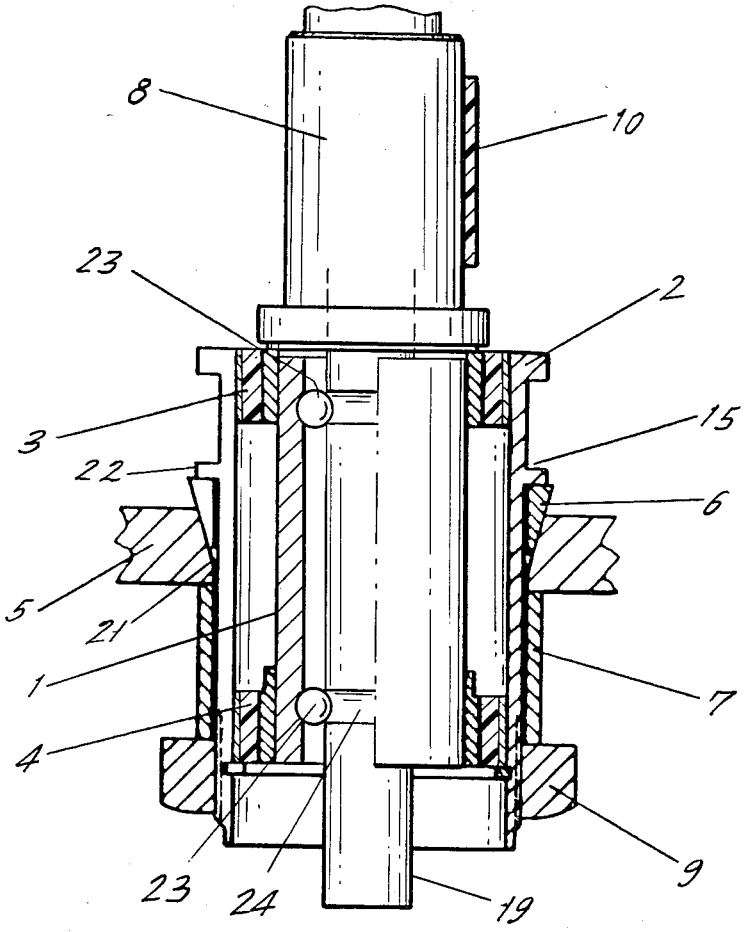
FIGS. 1–5 respectively show five embodiments of mounted spindles including slit sleeves and clamping according to the present invention.

In the embodiment of FIG. 1, a spindle 19 is supported to rotate in the stationary spindle housing 1 and the spindle 19, in turn, drives other objects, which are not shown, to rotate. For example, the spindle of this and all other embodiments may be used for spinning or twisting filaments that are used in making clothing. However, the particular application of the spindles is not critical to the invention. The spindle 19 is rigidly connected with a coaxial, axially offset, knurled surface drive whorl 8 or other belt engaging surface. A drive belt 10 moves past the whorl and frictionally engages it to rotate the whorl to rotate the spindle.

Referring to FIG. 1, spindle 19 is supported by roller bearings 23 in raceway 24 inside stationary cylindrical spindle housing 1.

Figure 6:
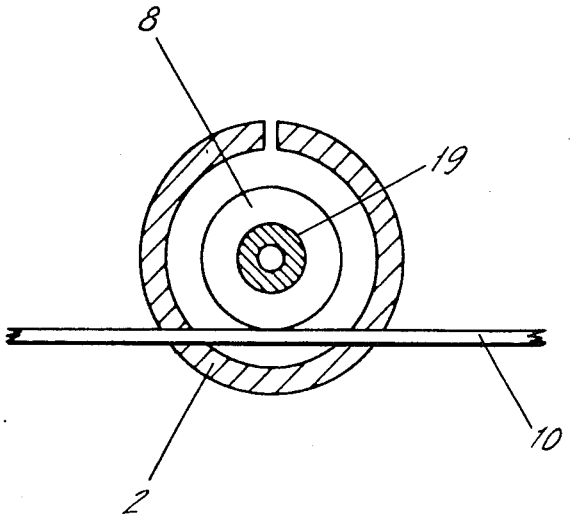
FIG. 6 is a top view of a spindle showing a drive belt contacting a drive whorl.
Figure 7:
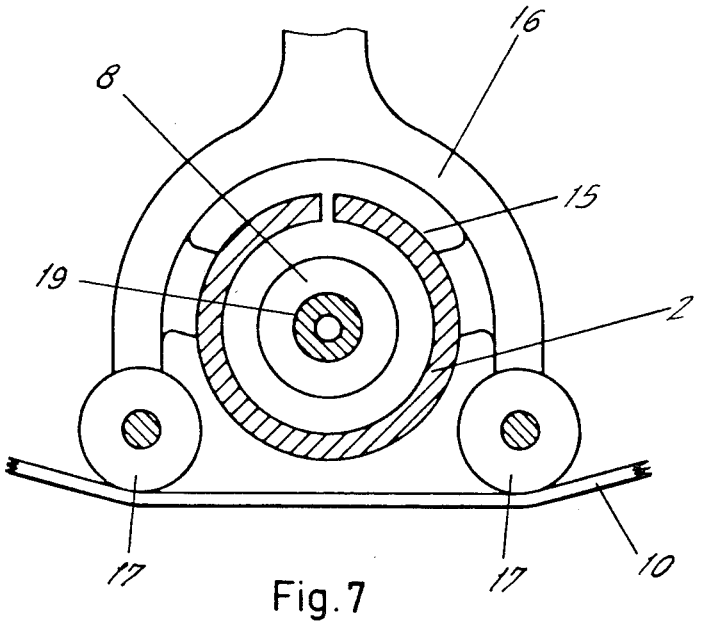
FIG. 7 is a top view of a spindle with a slit sleeve and a device for separating a drive belt from the drive whorl.

Referring to FIGS. 1, 6 and 7, there is disposed around the cylindrical spindle housing 1 a longitudinally extending annular sleeve 2 of steel which has a thin longitudinal slit running along its length at one side. The slit permits the sleeve to be slightly flexed outwardly and inwardly as needed for clamping and unclamping and for receiving the spindle, as described below. The slit sleeve in all of the embodiments has the above described characteristics.

In FIG. 1, there is disposed at both axial ends of the spindle housing 1 within the slit sleeve 2 two somewhat stiff but resilient annular damping elements, 3 at one end and 4 at the other end, which damp vibration of the spindle to minimize the effect of the vibration on the sleeve 2.

The spindle is to be supported to the common spindle bearing plate 5. That plate has respective recesses 21 through it for each of the spindles. For the spindle housing 1 in FIG. 1, the plate has a generally frustoconically shaped recess 21 which widens upwardly and in which the sleeve 2 is snugly fitted. In this and the other embodiments, the spindle sleeve 2 is slid axially into the recess 21 or into a clamping ring 6 in the recess which defines a sliding seat for the sleeve and the included spindle.

Along with the sleeve 2, in the frustoconical opening is disposed an annular clamping ring 6 with a frustoconically shaped exterior surface that is inclined to mate with the frustoconical opening in the plate 5 and with a cylindrical inner surface to mate with the cooperating exterior surface of the sleeve 2. The ring 6 in this as well as the other embodiments is also longitudinally slit, to facilitate the clamping. Above the clamping ring 6, the sleeve 2 has a flange 22 which rests on the top of the clamping ring 6 and is drawn down to press upon the clamping ring by means to be described below. This in turn presses the clamping ring 6 into the frustoconical opening in the bearing plate 5 and clamps in to the slit sleeve 2 and this securely holds the slit sleeve 2 to the bearing plate 5, securing the spindle to the plate. Radial and axial clamping is achieved by the spacer bushing 7 and by the threaded nut 9 which is threadedly secured on the threaded exterior of the lower end portion of the sleeve 2. In all embodiments, the nut 9 is threadedly supported on the sleeve and is movable therealong in the same way. When the nut 9 is tightened, the spacer bushing 7 is pressed up against the support plate 5, and the sleeve 2 is drawn down through the plate 5. The flange 22 on the sleeve above the clamping ring 6 pushes down on the clamping ring, which together rigidly secures the slit sleeve and therefore the entire spindle to the spindle bearing plate 5.

The grooves 15 extending from the top portion of the sleeve toward the plate 5 are instrumental in the separation of the drive belt 10 from the drive whorl 8 of the spindle, as is described in connection with FIG. 7 below. A similar set of grooves 15 is found in the other embodiments.

Figure 2:
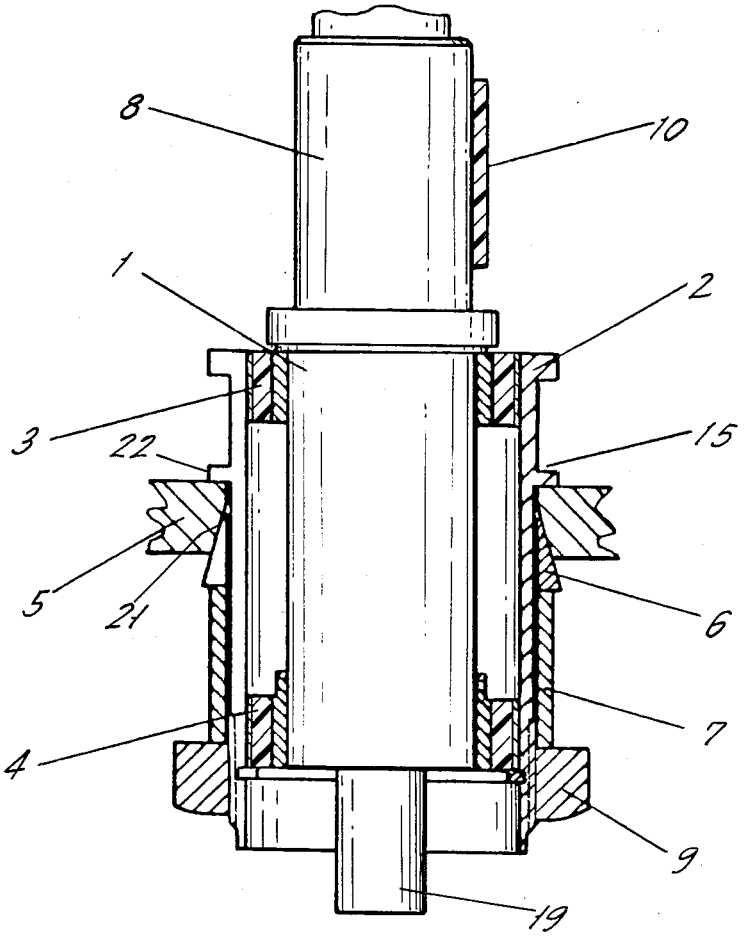

The second embodiment of FIG. 2 shows many elements in common with the first embodiment. In the second embodiment, as in the first embodiment, the spindle housing 1 is supported within the longitudinally slit sleeve 2 by means of the upper and lower damping elements 3 and 4, and the spindle 19 is driven to rotate through the drive whorl 8 being driven by the drive belt 10 in the same manner. In this embodiment, the flange 22 of the slit sleeve which is above the spindle bearing plate rests directly upon the spindle bearing plate, rather than upon the clamping ring. The spindle bearing plate has a frustoconically shaped recess 22 which conically widens in the downward direction, rather than in the upward direction as in FIG. 1.

The clamping ring 6 has a corresponding frustoconically shaped outside and cylindrical inside. The clamping ring 6 therefore is installed from below the plate 5, rather than from above. The clamping ring 6 in FIG. 2 is longitudinally slit. In this embodiment, radial and axial clamping of the slit sleeve 2 to the spindle bearing plate 5 is obtained via the spacer bushing 7 by means of the threaded nut 9 being threadedly tightened around the threaded exterior of the lower portion of the sleeve 2, which presses the spacer bushing 7 against the clamping ring 6 and drives the clamping ring 6 into the frustoconical recess in the spindle bearing plate 5, which securely clamps the slit sleeve 2 to the spindle bearing plate 5.

Figure 3:
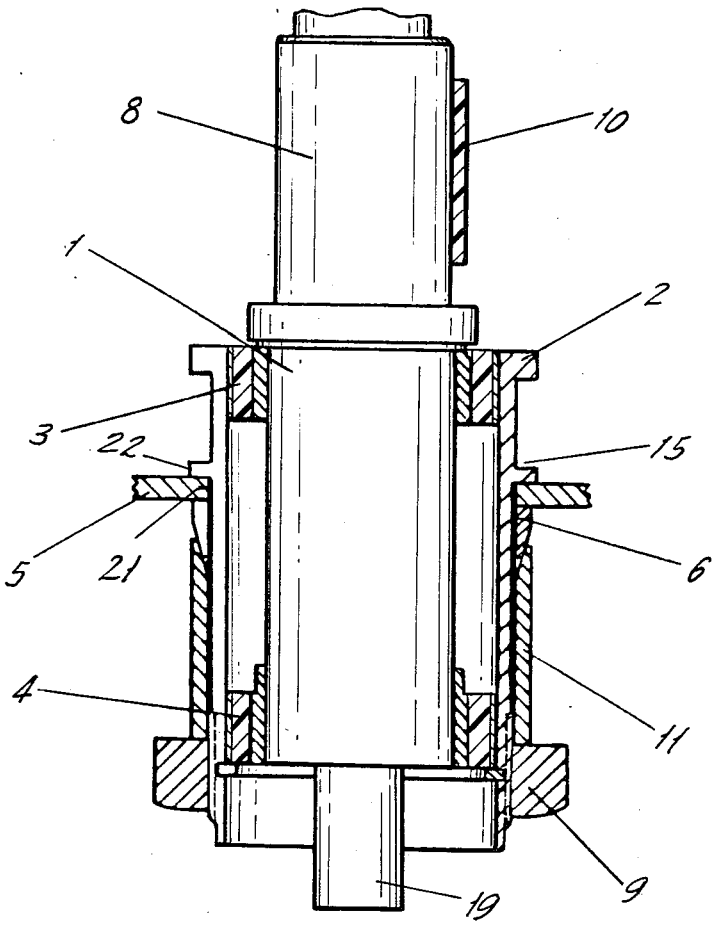

In the third embodiment of FIG. 3, the spindle housing 1 is supported in the longitudinally slit sleeve 2 and the drive whorl 8 of the spindle 19 is driven to move by the belt 10. The spindle is supported in the damping elements 3 and 4 in the slit sleeve 2. The spindle bearing plate 5 in this embodiment has a cylindrical recess 21, rather than a frustoconical opening in it, through which the slit sleeve passes. A flange 22 of the slit sleeve rests atop the spindle bearing plate.

Beneath the spindle bearing plate is disposed the separate, longitudinally slit clamping ring 6. The clamping ring 6 has a cylindrical interior and a frustoconically tapering exterior, which tapers narrower downwardly toward the spacer bushing 11. A spacer bushing 11 is disposed around the exterior of the slit sleeve 2. At its upper end, the bushing 11 has a frustoconically shaped opening which cooperates with the frustoconical exterior of the clamping ring. The threaded nut 9 is tightened up along the threaded exterior of the lower portion of the sleeve 2 which presses the spacer bushing 11 upwardly against the clamping ring 6. The frustoconically shaped surfaces have a wedge effect for driving the clamping ring 6 upwardly against the underside of the spindle bearing plate 5 while the flange 22 above the spindle bearing plate is drawn downwardly. This securely clamps the slit sleeve 2 to the spindle bearing plate 5.

Figure 4:
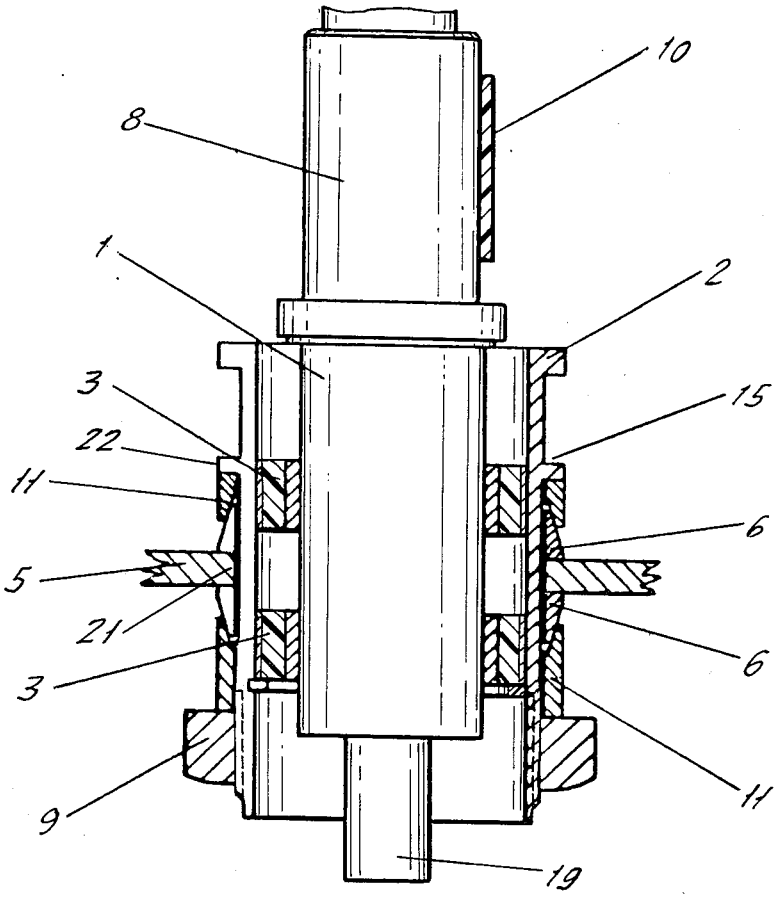

In the fourth embodiment of FIG. 4, the spindle housing 1 is supported inside the longitudinally slit sleeve 2 by the damping elements 3. The damping elements in this embodiment are spaced longitudinally inward from the ends of the slit sleeve at and below the described areas where the clamping connection between the slit sleeve and the respective clamping bushings is achieved. The sleeve 2 passes through the cylindrical opening 21 in the plate 5. In this embodiment, there are slit clamping rings 6 disposed both above and below the spindle bearing plate 5. Each of those clamping rings has a frustoconically shaped exterior which tapers inwardly, longitudinally away from the plate 5 and has a generally cylindrical interior which contacts the exterior of the sleeve 2.

A flange 22 on the sleeve 2 above the upper clamping ring 6 and the plate 5 presses downwardly on the upper spacer bushing 11. The interior of the upper spacer bushing 11 is frustoconically shaped to mate with the frustoconical exterior of the upper clamping ring 6.

Below the lower clamping ring 6 there is a lower spacer bushing 11 which also has a frustoconically shaped interior that mates with the frustoconical exterior of the lower clamping ring 6.

Upon tightening of the threaded nut 9 over the lower threaded portion of the sleeve 2, the flange above the upper spacer bushing 11 is pulled downwardly against the upper spacer bushing and the lower spacer bushing 11 is pushed upwardly. The spacer bushings 11 cooperate with their respective clamping rings 6 for securely clamping the sleeve 2 to the spindle bearing plate 5.

Figure 5:
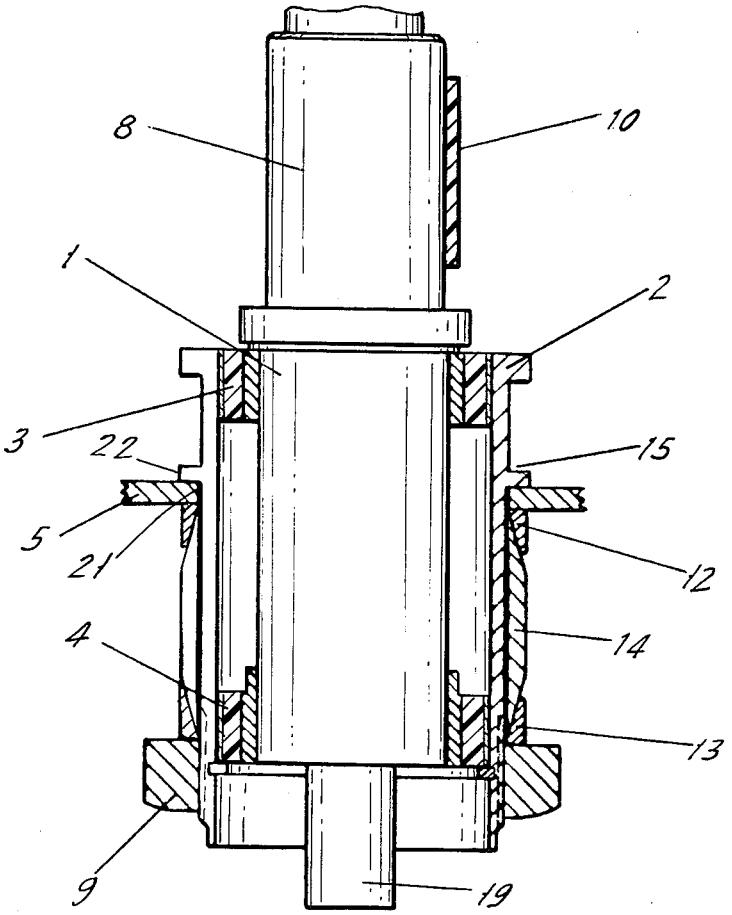

In the fifth embodiment of FIG. 5, the spindle housing 1 is supported for rotation which is caused by the drive whorl 8 being driven by the belt 10. The spindle housing 1 is supported in the upper and lower damping elements 3, 4 in the slit sleeve 2. The sleeve passes through the cylindrical opening 21 in the plate 5.

In this embodiment, there is a flange 22 on the sleeve 2 which presses down upon the upper surface of the spindle bearing plate 5. There is an upper spacer ring 12 directly beneath the plate 5 and a lower spacer ring 13 directly above the threaded nut 9. The interiors of both of the spacer rings 12 and 13 are frustoconically shaped, and both open wider toward one another. Disposed longitudinally between the frustoconical spacer rings 12 and 13 is the longitudinally elongate, longitudinally slit clamping ring 14 which has a frustoconically shaped top and bottom end which cooperates with the frustoconical openings in the spacer rings 12 and 13.

Upon tightening of the threaded nut 9 over the lower end of the exterior of the sleeve 2, the sleeve 2 is pulled downwardly and force is applied upwardly against the lower spacer ring 13. This securely clamps the sleeve 2 to the spindle bearing plate 5.

In all embodiments, removal of the sleeve 2 along with the spindle housing 1 that it supports from the spindle bearing plate 5 merely requires loosening of the nut 9 which frees the respective wedge clamping of the respective embodiment. Then the spindle sleeve 2 may be removed from the opening in the spindle bearing plate and the spindle is then removed from the slit sleeve. The wedge connections of each of the embodiments secures the sleeve 2 to the spindle bearing plate. However, it does not interfere with the removal of the sleeve from the spindle bearing plate to enable easy removal of the spindle. The spindle is simply removed by lifting it up out of the spindle bearing plate once the nut 9 has been removed.

As noted above, one of the primary objectives of the invention is to enable the removal of one spindle 19 without interfering with the continuous operation of the other spindles. FIG. 6 shows the drive belt 10 resting against the drive whorl 8 of the respective spindle 19 which spindle is surrounded by the longitudinally slit sleeve 2.

FIG. 7 shows a respective drive belt lifting device 16 which is useful with each of the five above-described embodiments of clamped slit sleeves. That belt lifting device is guided in the respective guide grooves 15 of the respective slit sleeve 2 to lift the drive belt 10 off the respective drive whorl 8. The lifting device has freely movable lift off rollers 17 which are supported on respective arms of the device 16 and are pressed against the belt to raise it off the drive whorl. The rollers 17 now free the spindle from the drive belt, which permits the spindle to be braked and thereafter removed, without interfering with the operation of the other spindles. Subsequent installation of the same spindle or a replacement spindle would involve the same initial raising of the belt to be away from the drive whorl to be installed, the installation of the spindle on the spindle bearing plate and the clamping of the spindle there, and the removal of the lifting device which would return the drive belt to driving the drive whorl, all without interfering with the operation of the other spindles.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. In combination a rotatable spindle, a spindle bearing plate and a stationary spindle housing in which the spindle is supported to rotate;

a drive whorl on the spindle, a movable belt engageable with the drive whorl for rotating the spindle; belt lifting means removably attachable to the spindle for lifting the drive belt off the drive whorl to halt the driving of the spindle;

an annular sleeve surrounding and supporting the spindle housing; the spindle bearing plate having a recess in it; the sleeve passing through the recess;

clamping means for both axially and radially clamping the sleeve in the recess to the spindle bearing plate; the clamping means comprising a nut supported on the sleeve at one side of the bearing plate for being moved along the sleeve, comprising first means on the sleeve at the other side of the bearing plate from the nut and comprising wedge shaped clampable means disposed around the sleeve; the clampable means including a first part which is wedge shaped and presses against the sleeve and a second part movable with respect to the first part which is correspondingly wedge shaped to the first part, the clampable means being connected between the nut and the first means, such that moving the nut in one direction drives the first means toward the spindle bearing plate for axially clamping the sleeve and the housing within it to the spindle bearing plate and moves the second part with respect to the first part to wedge the first part of the clampable means radially inward toward the sleeve for radially clamping the sleeve and the housing.

2. The combination of claim 1, wherein the sleeve is longitudinally slit.

3. The combination of claim 1, wherein the first means of the sleeve includes a flange placed at the opposite side of the spindle bearing plate from the nut for pressing upon the spindle bearing plate, so that as the nut is moved along the sleeve toward the spindle bearing plate, the sleeve is pulled by the nut to pull the flange toward the nut and to press upon the spindle bearing plate while the clampable means is urged by the nut to clamp the sleeve to the spindle bearing plate.

4. The combination of claim 2, further comprising damping elements disposed between the spindle housing and the sleeve, for damping vibration of the spindle and the spindle housing with respect to the sleeve.

5. The combination of claim 4, wherein the spindle bearing plate recess comprises the second part of the clampable means, is frustoconically shaped and conically widens in the direction above the plate;

the clampable means first part comprises a clamping ring with a frustoconically shaped exterior which fits in the recess in the plate and with an interior around the sleeve; a spacer bushing communicating between the nut and the underside of the spindle bearing plate; the flange of the sleeve pressing upon the clamping ring upon the tightening of the nut.

6. The combination of claim 5, wherein the clamping ring is longitudinally split.

7. The combination of claim 4, wherein the spindle bearing plate recess comprises the second part of the clampable means, is frustoconically shaped and conically widens in the direction below the spindle bearing plate; the clampable means first part comprises a clamping ring with a frustoconically shaped exterior which fits in the recess in the spindle bearing plate and with an interior around the sleeve; a spacer bushing disposed between the nut and the clamping ring such that tightening of the nut on the sleeve presses the clamping ring into the recess in the spindle bearing plate for clamping the sleeve.

8. The combination of claim 7, wherein the clamping ring is longitudinally split.

9. The combination of claim 4, wherein the clampable means first part comprises a clamping ring disposed beneath the spindle bearing plate and externally frustoconically shaped to taper narrower away from the spindle bearing plate and with an interior on the sleeve; the clampable means second part comprises a spacer bushing disposed on the sleeve at and below the clamping ring with a frustoconically shaped opening for mating with the frustoconically shaped exterior of the clamping ring;

the nut being tightenable from below against the spacer bushing for tightening the spacer bushing against the clamping ring and the clamping ring being tightenable against the spindle bearing plate for securing the slit sleeve in the recess in the spindle bearing plate.

10. The combination of claim 9, wherein the clamping means is longitudinally split.

11. The combination of claim 4, whrein the clampable means first part comprises a respective clamping ring both above and below the spindle bearing plate and each of the clamping rings being frustoconically shaped on its exterior and tapering radially narrower away from the spindle bearing plate; the clampable means second part comprises a respective spacer bushing around the sleeve, both above the upper clamping ring and below the lower clamping ring, each spacer bushing having a frustoconically shaped opening to mate with the frustoconical exterior of the respective clamping ring; the first means on the sleeve pressing upon the upper clamping ring; the nut being tightenable against the lower spacer bushing for pressing up upon the lower spacer bushing to clamp the lower clamping ring, and the tightening of the nut also drawing the first means down against the upper spacer bushing for tightening that busing against the upper clamping ring, for securing the slit sleeve in the recess in the spindle bearing plate.

12. The combination of claim 11, wherein the clamping ring is longitudinally split.

13. The combination of claim 4, wherein the clampable means second part comprises an upper frustoconically shaped bushing around the sleeve and beneath the spindle bearing plate and a lower frustoconically shaped bushing around the sleeve and above the tightenable nut and the first part of the clampable means comprises a clamping ring disposed between the upper and low bushings for being received in the frustoconical bushings; the first means of the sleeve pressing down upon the spindle bearing plate, such that upon tightening of the nut along the sleeve, the nut presses up upon the lower bushing and the first means draws down upon the spindle bearing plate, for thereby securing the clamping ring in the clamping bushings for securing the sleeve in the recess in the spindle bearing plate.

14. The combination of claim 13, wherein the clamping ring is longitudinally split.

15. The combination of claim 4, wherein the clampable means are disposed longitudinally between the damping elements along the spindle.

16. The combination of claim 4, wherein the clampable means are disposed longitudinally between the plate and at least one of the damping elements.

17. The combination of claim 4, further comprising means on the sleeve for supporting the belt lifting means.

18. The combination of claim 17, wherein the sleeve is provided with holding, guide grooves for the belt lifting means.

19. The combination of claim 18, wherein the holding, guide grooves are defined on the slit sleeve longitudinally above the spindle bearing plate.

20. The combination of claim 2, wherein the slit sleeve is comprised of steel.

* * * * *